United States Patent [19]

Bielefeld

[11] Patent Number: 4,606,597

[45] Date of Patent: Aug. 19, 1986

[54] ELECTRICAL CONNECTOR

[76] Inventor: Gerhard Bielefeld, P.O. Box 368, Stony Plain, Alberta, T0E 2G0, Canada

[21] Appl. No.: 703,336

[22] Filed: Feb. 20, 1985

[30] Foreign Application Priority Data

Nov. 9, 1984 [CA] Canada ..... 467462

[51] Int. Cl.[4] ..... H01R 3/00

[52] U.S. Cl. ..... 339/113 L; 339/147 P; 339/166 R

[58] Field of Search ..... 339/113, 147 R, 147 P, 339/166, 218 R, 218 M

[56] References Cited

U.S. PATENT DOCUMENTS

| | | | |
|---|---|---|---|
| 3,383,588 | 5/1968 | Stoll et al. | 339/113 L |
| 3,808,581 | 4/1974 | Murray | 339/147 R |
| 3,890,030 | 6/1975 | McDaniel | 339/147 P |
| 4,350,407 | 9/1982 | Tong | 339/147 P |
| 4,386,818 | 7/1983 | Millhimes et al. | 339/113 L |

FOREIGN PATENT DOCUMENTS

| | | | |
|---|---|---|---|
| 2845587 | 10/1979 | Fed. Rep. of Germany | 339/113 L |
| 2084812 | 4/1982 | United Kingdom | 339/147 R |

*Primary Examiner*—Gil Weidenfeld
*Assistant Examiner*—David L. Pirlot
*Attorney, Agent, or Firm*—Bell, Seltzer, Park & Gibson

[57] ABSTRACT

An electrical connector has a cavity formed in a body and a lamp accommodated within the cavity, with at least one aperture in the body through which light can pass from the lamp to the exterior of the body. The body is molded in one piece around electrically conductive members for conducting electricity through the connector, and the lamp is provided with contacts in frictional engagement with the electrically conductive members for illumination of the lamp. The lamp is inserted into the cavity through an opening, which is provided with a closure.

6 Claims, 4 Drawing Figures

ELECTRICAL CONNECTOR

BACKGROUND OF THE INVENTION

The present invention relates to electrical connectors and is useful, in particular, for electrical plugs and adapters for connection to sockets, e.g. wall sockets.

In my previous Canadian Pat. No. 717,200, I have disclosed an electrical plug provided with an indicator lamp for indicating when electricity is available at an electrical outlet when the plug is inserted into the outlet.

One embodiment of the electrical plug shown in Canadian Pat. No. 717,200 has a neon indicating lamp embedded in a molded plug body. This embodiment, however, involves the problem that the lamp may be damaged by the heat and/or pressure of the material of the plug body as the plug body is molded around the lamp.

Another embodiment of the electrical plug shown in Canadian Pat. No. 717,200 has a lamp, a pair of electrical prongs and a body member, the lamp being fitted into a socket drilled in the body member and being connected to the prongs and the unit comprising the body member, the prongs and the lamp being inserted into a cover member provided with an opening through which the light of the lamp can be seen from the exterior.

In both embodiments of this prior plug, the indicator lamp and a resistor associated therewith are connected to the prongs of the plug by wires, which can somewhat easily become damaged. Also, the manufacturing process of this prior plug is slow and relatively expensive.

SUMMARY OF THE INVENTION

It is an object of the present invention to provide a novel and improved electrical connector which incorporates an indicator lamp for indicating the availability of electrical current through the connector and which is simpler and more economical to manufacture than comparable prior art connectors.

According to the present invention, there is provided an electrical connector which comprises a body, a cavity formed within the body, a lamp accommodated in the cavity, at least one aperture in the body through which light can pass from the lamp to the exterior of the body, electrically conductive members within the body for conducting electricity through the connector, means for electrically connecting the electrically conductive members to the lamp for illumination of the lamp by the electricity, the body being molded in one piece around the electrically conductive members, the cavity having an opening to the exterior of the body, and closure means for closing the opening.

In a preferred embodiment of the present invention, the electrical connecting means comprise contact members in frictional engagement with the electrically conductive members, which are exposed to the interior of the cavity for engagement with the contact members. The lamp and the contact members from parts of a lamp unit inserted into the cavity, the lamp unit including voltage reduction means for reducing the voltage of the electricity as the electricity is applied to the lamp.

The electrically conductive members may comprise pins projecting from the body of the electrical connector and/or sockets provided within the body of the electrical connector.

BRIEF DESCRIPTION OF THE DRAWINGS

The invention will be more readily understood from the following description of preferred embodiments thereof given, by way of example, with reference to the accompanying drawings, in which.

DESCRIPTION OF THE PREFERRED EMBODIMENTS

Figure 1:
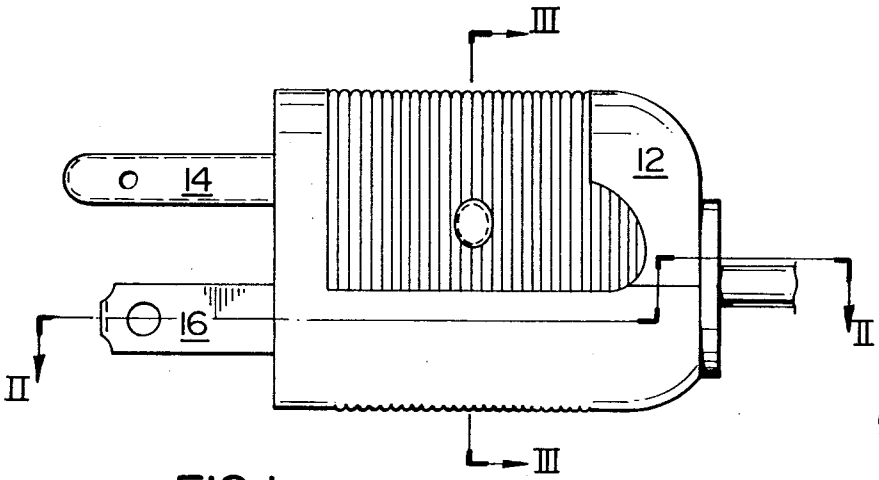
FIG. 1 shows a side view of an electrical connector according to a first embodiment of the present invention.
Figure 3:
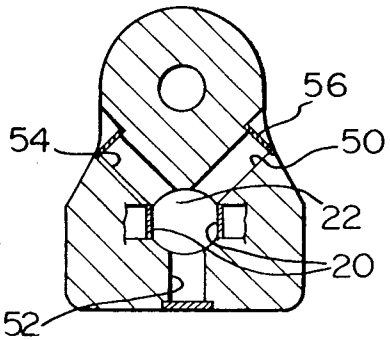
FIG. 3 shows a view taken in transverse cross sectional along the line III—III of FIG. 1.
Figure 2:
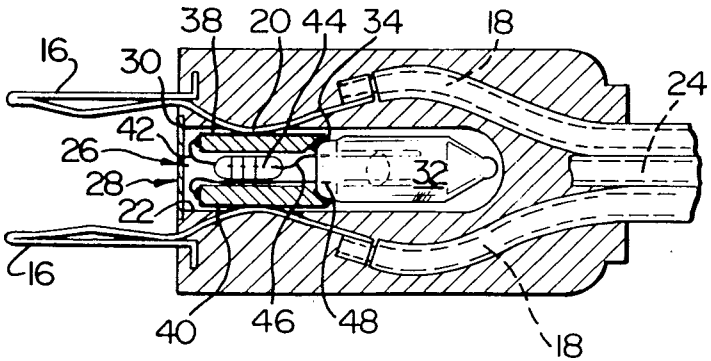
FIG. 2 shows a view taken in cross-section along the line II—II of FIG. 1.

The electrical plug illustrated in FIGS. 1 to 3 of the accompanying drawings and indicated generally by reference numeral 10 has a body 12 which is molded in one piece of resilient material, for example hard rubber or other elastomeric material, of an electrically insulating nature.

This embodiment of the invention is a three-pin plug which has a ground pin 14 and two further pins 16 extending from the plug body 12.

As can be seen from FIG. 2, the pins 16 are formed by end portions of metal strips which are connected to respective electrical conductors 18 and which are formed with bent intermediate portions 20.

The plug body 12 is formed with a cavity 22, and the bent intermediate portions 20 of the metal strips extend into the cavity 22 at opposite sides thereof, as can be seen from FIG. 3.

The conductors 18 form part of a cable having a third conductor 24 which is connected as a ground lead to the ground pin 14.

An indicator lamp unit indicated generally by reference numeral 26 is inserted into the cavity 22 through an open end 28 of the cavity 22, the open end 28 being closed by a closure plate 30 secured by adhesive (not shown) to the plug body 12.

The indicator lamp unit 26 comprises an indicator lamp 32, which is secured by adhesive 34 to a cylindrical piece 36 of electrically insulating material. Slide contact members 38 and 40 are secured to the cylindrical piece 36, at opposite sides thereof and at the outer periphery thereof.

The contact member 38 is connected by solder to a conductor wire 42 extending from one end of a resistor 44, a conductor wire 46 extending from the other end of the resistor 44 to the lamp 32 and a further conductor wire 48 extending from the lamp 32 to the side contact 40 and being soldered thereto.

As is apparent from FIG. 2, the slide contacts 38 and 40 are in sliding contact or engagement with the intermediate portions 20 of the electrically conductive members. Thus, the lamp 32 is connected in series with the resistor 44 across the conductors 18 so as to be illuminated when the conductors 18 are in connection with a source of electrical energy, the voltage across the conductors 18 being stepped down by the resistor 44 before being applied to the lamp 32 in order to avoid damage to the latter.

It should in particular be noted that, with the plug construction thus far described, the body 12 is molded around the electrically conductive members forming the pins 16 and around the electrical conductors 18, but is not molded around the indicator lamp unit 26. It should furthermore be noted that the indicator lamp unit 26 is formed entirely separately from the remainder of the plug and, after molding of the plug body 12, is slidingly inserted into the plug body cavity 22, into electrical contact with the intermediate portions 20 of the electrically conductive members, so that the lamp 32 is in no way affected by the heat and/or temperature of the material of the plug body 12 during the molding of the plug body 12 when the plug is manufactured.

The plug body 12 is, furthermore, formed with three passages 50, 52 and 54 which extend from the cavity 22, and from the vicinity of the lamp 32, to the outer surface of the plug body 12, thus providing apertures or passages for the transmission of light from the lamp 32 to the exterior of the electrical plug, the passages 50 being closed by translucent closure members or windows 56, which may for example be made of plastics material and secured by adhesive or otherwise across these passages.

Figure 4:
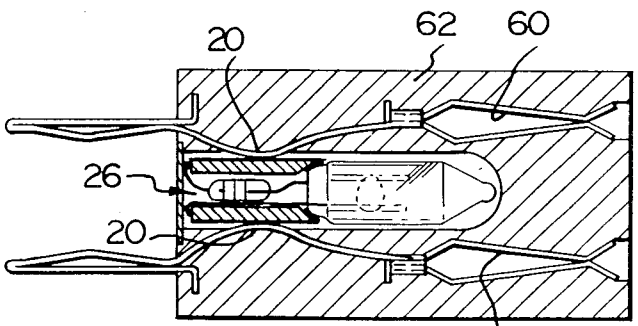
FIG. 4 shows a view corresponding to FIG. 2 but of a male/female connector.

In the second embodiment of the invention, illustrated in FIG. 4, the electrically conductive members, instead of being connected to electrical conductors 18 as in FIG. 2, are extended to the rear of the electrical connector, where they form parts of sockets 60 embedded in the plug body, which in this embodiment is indicated by reference numeral 62, the plug socket 60 serving to receive electrical connector pins, such as the pins 16, of an electrical plug (not shown).

Otherwise, the electrical connector illustrated in FIG. 4 is similar to that of FIGS. 1 to 3 and, in particular, has the same indicator lamp unit 26 inserted into sliding engagement with the intermediate portions 20 of the electrically conductive members as in the embodiment of FIGS. 1 to 3. The connector of FIG. 4 may, for example, be connected between a conventional plug and an outlet.

It is envisaged that the present invention will be particularly useful when embodied as an electrical plug provided on the lead of a block heater, in which case the user of the block heater can be certain whether or not the heater is being energized, when the plug is inserted into an outlet, by determining whether or not the indicator lamp 32 has been illuminated.

The invention is not, however, restricted to plugs for block heaters and may, for example, be employed on leads of other electrical devices and appliances in order to provide a visual indication of whether or not electricity is available when the electrical connector is coupled with an electrical outlet or other electrical connector.

The plugs shown in the accompanying drawing have the advantages that they are molded in one piece, and are therefore relatively simple and economical to manufacture and that they provide a good electrical connection to the bulb, with a reduced risk of damage to the bulb by the handling of the bulb.

I claim:

1. An electrical connector, comprising:

a body;

a cavity formed within said body;

a lamp unit replaceably accommodated in said cavity;

at least one aperture in said body through which light can pass from said lamp unit to the exterior of said body;

electrically conductive members within said body for conducting electricity through said connector, said cavity being located between said electrically conductive members;

said lamp unit comprising a lamp, contact members provided on said lamp unit and frictionally engaging said electrically conductive members at opposite sides of said lamp unit for connecting said lamp across said electrically conductive members and voltage reduction means connected between said lamp and one of said contact members for reducing the voltage applied across said lamp by said electrically conductive members;

said lamp, said contact members and said voltage reduction means being formed as integral members of said lamp unit;

said body being molded in one piece around said electrically conductive members; and said cavity having an opening to the exterior of said body to permit the insertion of said lamp into said cavity; and closure means for closing said opening.

2. An electrical connector as claimed in claim 1, wherein said electrically conductive members include pins projecting from said body.

3. An electrical connector as claimed in claim 1, wherein said electrically conductive members form sockets within said body.

4. An electrical connector as claimed in claim 1, further comprising translucent means for closing said aperture while allowing light to pass from said lamp through said aperture to the exterior of said body.

5. An electrical connector, comprising a pair of spaced electrically conductive members;

a body molded in one piece around said electrically conductive members;

said body defining a cavity between said electrically conductive members;

said electrically conductive members forming a pair of connecting pins projecting from one end of said body and including portions extending within said body through a wall of said cavity at opposite sides of said cavity;

a lamp inserted into said cavity;

said lamp having a pair of spaced contact members in sliding engagement with said portions of said electrically conductive members for connecting said lamp across said electrically conductive members; and an opening extending from said cavity to the exterior of said body through which light from said lamp is visible when said lamp is illuminated.

6. An electrical connector as claimed in claim 5, wherein said lamp forms part of a lamp unit replaceably inserted into said cavity and said lamp unit includes a resistor connected between said lamp and one of said contact members.

* * * * *